US009505523B2

(12) United States Patent
Irsch et al.

(10) Patent No.: US 9,505,523 B2
(45) Date of Patent: Nov. 29, 2016

(54) FOOD PACKAGE

(71) Applicant: LAND O'FROST, INC., Lansing, IL (US)

(72) Inventors: Craig Irsch, Searcy, AR (US); William Marion, Searcy, AR (US); James Joseph Feeney, II, Nortonville, KY (US)

(73) Assignee: Land O'Frost, Inc., Lansing, IL (US)

( * ) Notice: Subject to any disclaimer, the term of this patent is extended or adjusted under 35 U.S.C. 154(b) by 0 days.

(21) Appl. No.: 14/733,682

(22) Filed: Jun. 8, 2015

(65) Prior Publication Data

US 2015/0291308 A1 Oct. 15, 2015

Related U.S. Application Data

(63) Continuation-in-part of application No. 13/829,453, filed on Mar. 14, 2013, now abandoned.

(51) Int. Cl.

| | |
|---|---|
| ***B65D 21/02*** | (2006.01) |
| ***B65D 43/02*** | (2006.01) |
| *B65D 1/44* | (2006.01) |
| *B65D 1/46* | (2006.01) |

(52) U.S. Cl.

CPC ..... *B65D 21/0219* (2013.01); *B65D 43/021* (2013.01); *B65D 43/022* (2013.01); *B65D 1/44* (2013.01); *B65D 1/46* (2013.01); *B65D 2543/0062* (2013.01); *B65D 2543/00101* (2013.01); *B65D 2543/00509* (2013.01); *B65D 2543/00694* (2013.01); *B65D 2543/00731* (2013.01); *B65D 2543/00805* (2013.01)

(58) Field of Classification Search

CPC ..... B65D 21/0223; B65D 43/021; B65D 43/022; B65D 1/44; B65D 1/46; B65D 21/0219; B65D 25/24

USPC ..... 220/780, 671, 268; 206/508, 503, 206/45.24, 736

See application file for complete search history.

(56) References Cited

U.S. PATENT DOCUMENTS

| | | | | | |
|---|---|---|---|---|---|
| 3,630,346 | A | * | 12/1971 | Burnside | B65D 75/32 206/445 |
| 4,236,637 | A | * | 12/1980 | Castner, Sr. | A61F 15/001 206/362 |
| 4,901,858 | A | * | 2/1990 | Anderson | B29C 51/04 206/461 |
| 4,962,849 | A | * | 10/1990 | Anderson | B65D 77/2096 206/45.24 |
| 5,564,569 | A | * | 10/1996 | Kiefer | B65D 75/36 206/461 |
| 5,657,874 | A | * | 8/1997 | Hustad | B65D 1/36 206/45.24 |
| 5,695,798 | A | * | 12/1997 | Rozzano | B65D 21/0233 206/518 |

(Continued)

*Primary Examiner* — Steven A. Reynolds
(74) *Attorney, Agent, or Firm* — Reed Smith LLP

(57) ABSTRACT

Packages for the stable display and storage of foodstuffs. Re-closeable foodstuff package are provided that include a container and a lid. A front wall has a negative draft angle to the base of the container. The negative draft angle of the wall and a rim of the container enable the package to be displayed in a vertical or near vertical orientation. Additionally, a lip and front edge near the base of the container allows the packages to be stacked stably while in a horizontal position to allow for easy shipping of quantities of the packages to stores for sale.

22 Claims, 19 Drawing Sheets

(56) References Cited

U.S. PATENT DOCUMENTS 5,795,604 A * 8/1998 Wells ..... B65D 43/021 206/471
6,155,423 A * 12/2000 Katzner ..... B65D 75/327 206/469
7,172,779 B2 * 2/2007 Castellanos ..... B65D 1/34 206/714
D556,567 S * 12/2007 Templeton ..... D9/420
7,475,780 B2 * 1/2009 Hinze ..... B65D 21/0219 206/469
7,810,302 B2 * 10/2010 Hinze ..... B65D 43/021 53/122
8,911,807 B2 * 12/2014 Hinze ..... B65D 77/2072 220/784
2009/0186132 A1 * 7/2009 Mangino ..... B65D 1/36 426/120
2012/0181280 A1 * 7/2012 Barbier ..... B65D 43/162 220/269
2013/0068654 A1 * 3/2013 MacDonald ..... B65D 47/043 206/524.6

* cited by examiner

FOOD PACKAGE

CROSS-REFERENCE TO RELATED APPLICATION

This application claims priority from U.S. patent application Ser. No. 13/829,453 that was filed on Mar. 14, 2013 and is incorporated in its entirety herein by reference.

BACKGROUND OF THE INVENTION

1. Field of the Invention

The present invention relates generally to packaging for food items, and more particularly to stackable display packaging for perishable food items.

2. Description of the Background

The display and presentation of food items is of great concern in the food industry. The commercially effective display of food items allows the consumer to view the foodstuff to be purchased, while at the same time properly designed packages preserve the freshness of the product. Because of the diversity of sales spaces in stores, an effective food package should allow display of the foodstuff in a variety of configurations, e.g., with the face of the package towards the consumer or with multiple packages stacked vertically on a shelf one on top of one another.

Food packages that include a re-closable container are particularly appealing to consumers in that they allow reuse of the container. Re-closable containers permit a consumer to maintain the freshness of purchased food products after the packaging is initially opened by the consumer.

Additionally, food packaging should be structured to allow easy and efficient transport of numerous packages from the factory where they are made to the stores where they are sold.

BRIEF DESCRIPTION OF THE DRAWINGS

The present invention will be described in conjunction with the following figures, wherein like reference characters designate the same or similar elements, which figures are incorporated into and constitute a part of the specification, wherein.

SUMMARY OF THE INVENTION

Figure 1:
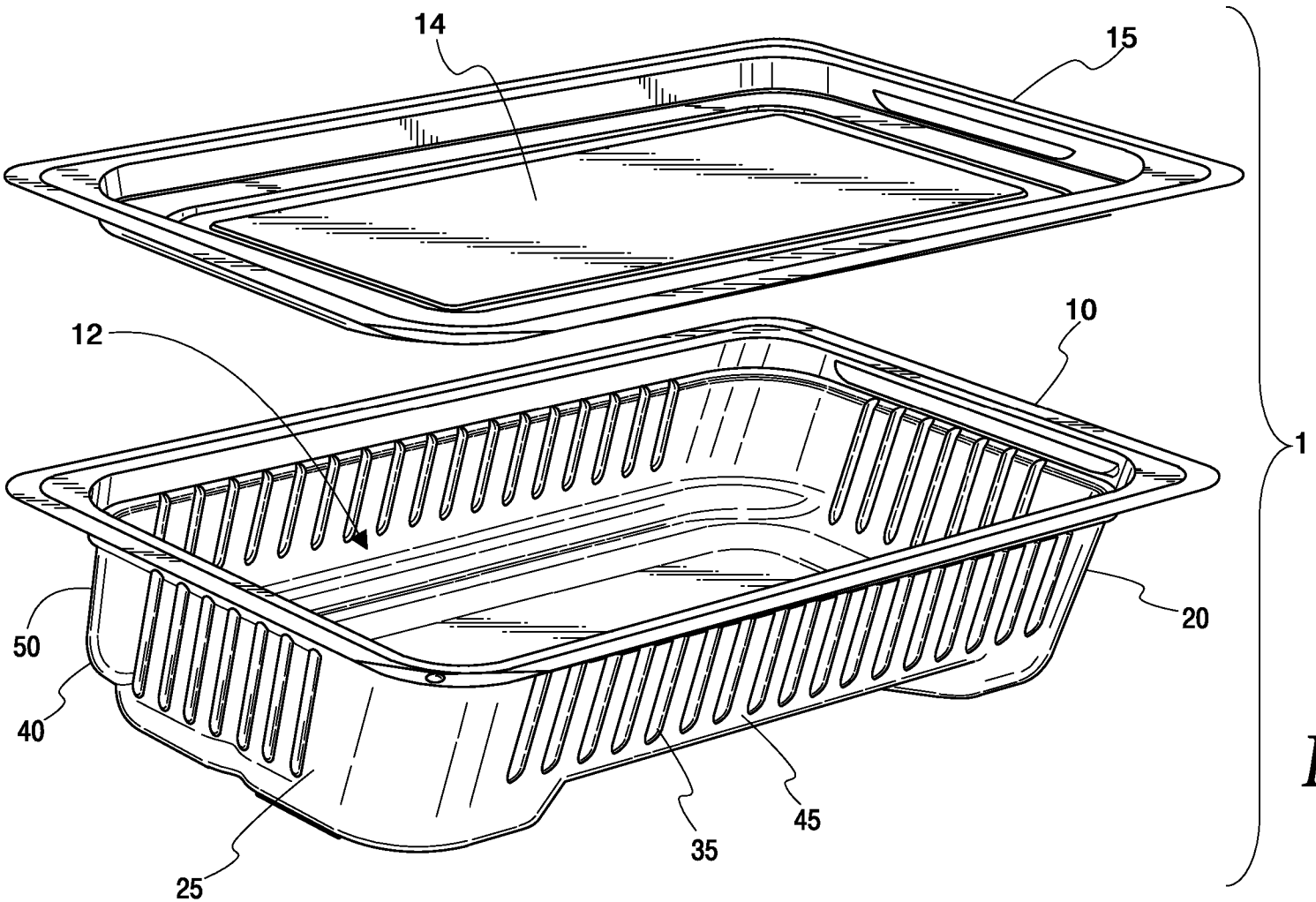
FIG. 1 shows a profile view of a first embodiment of a package, including a container and lid, of the present invention.

The present invention provides a novel, re-closeable foodstuff package that includes structure so that the package can be stacked both in a horizontal position for shipping and placed vertically to allow for the display of the foodstuff. The present invention includes a container for enclosing foodstuffs and a lid which may snap fit snugly on the container to re-close the container and help maintain the freshness of the foodstuffs inside. The container is defined by a base and four walls. The two side walls of the container preferably extend vertically from the base. The front and rear walls preferably extend substantially vertically from the base and roughly parallel to one another, with the front wall angled slightly towards the center of the container and the rear wall slightly away from the center of the container. In certain embodiments, the lid is hingedly attached to the container. A lip is formed where the front of the base is set back slightly from the front wall of the container. The container may also include a rim that extends horizontally from the top of the walls. The lid fits into the top of the container to seal the foodstuffs within. The lid also includes a horizontal rim that is sealed to the container along the horizontal rim of the container. The package is opened by peeling the lid away from the container and then the lid can be snap fit snuggly back into the container to re-close the container and maintain freshness of the foodstuffs within.

The packages of the present invention may be displayed in a near-vertical orientation such that the front wall of the container faces the shelf on which the product is placed. In this near-vertical orientation, the package rests on the horizontal rim and the lip stably, thus allowing the product to be displayed to consumers effectively. The overall structure of the package, particularly the negative angle of the front wall, places the center of mass of the product-containing packages substantially directly above the front wall when a package is oriented in the near-vertical position. This allows the package to rest stably on the horizontal rim and the lip with a reduced likelihood of the package tipping over. The packages of the present invention may also be stacked in a horizontal orientation. To allow the stable stacking of packages of the present invention, the base of the container nests firm into the lid of the container below it. Also, to facilitate stable stacking of the packages, the base ends rearward of the front wall, so that when the base of a top package is nested into the lid of a lower package, the center of gravity of the top package remains in line with the center of gravity of the lower package.

The present invention provides a package for containing a foodstuff, comprising a container and a lid. The container has a base with a perimeter and two side walls opposite one another and a rear wall opposite a front wall. The side walls extend substantially vertically from the perimeter of the base. The front wall extends at a negative angle relative to the base towards the center of the container. The rear wall may be substantially parallel to the front wall. The container also includes a substantially horizontal rim that is disposed along a top portion of the walls, opposite the base. The front edge of the base is set back from the front wall so that the transition of the front wall defines a lip where the base transitions to the front wall of the container to provide stability when the packages are vertically stacked. The packages of the present invention also include a lid that is capable of fitting snugly into the rim to contain foodstuffs placed in the container.

The packages of the present invention may be oriented stably in a near-vertical position where the package rests on the horizontal rim and the lip rest on a horizontal surface. When in this orientation, the center of mass of said package is located above said front wall of the package because of the negative angle of the front wall.

DETAILED DESCRIPTION OF THE INVENTION

It is to be understood that the figures and descriptions of the present invention have been simplified to illustrate elements that are relevant for a clear understanding of the invention, while eliminating for purposes of clarity, other elements that may be well known. The detailed description will be provided hereinbelow with reference to the attached drawing.

The present invention provides packages that allow foodstuffs to be presented in a variety of display spaces in stores. The present invention provides several components including a container for enclosing foodstuffs and a lid that snap fits snugly onto the container to re-close the container and help maintain the freshness of the foodstuffs inside after opening by the consumer. The systems of the present invention are particularly well suited for the display of lunch meats and other perishable foodstuffs, though may be used for any type of food display. Through the novel and innovative design of the present invention, packages containing foodstuffs may be placed stably in a near-vertical display position where a broad face of the package faces consumers.

A first embodiment of the present invention is shown in FIG. 1. The package 1 of the present invention preferably includes a container 10 and a lid 15. A recessed portion 14 of the lid 15 preferably recesses into the top-most portion of container 10 and snap fits snugly into the container 10, thus closing the container, which helps to maintain the freshness of the foodstuffs that may be placed inside. In some presently preferred embodiments the container is approximately rectangular in shape, as shown in FIG. 1.

Figure 2:
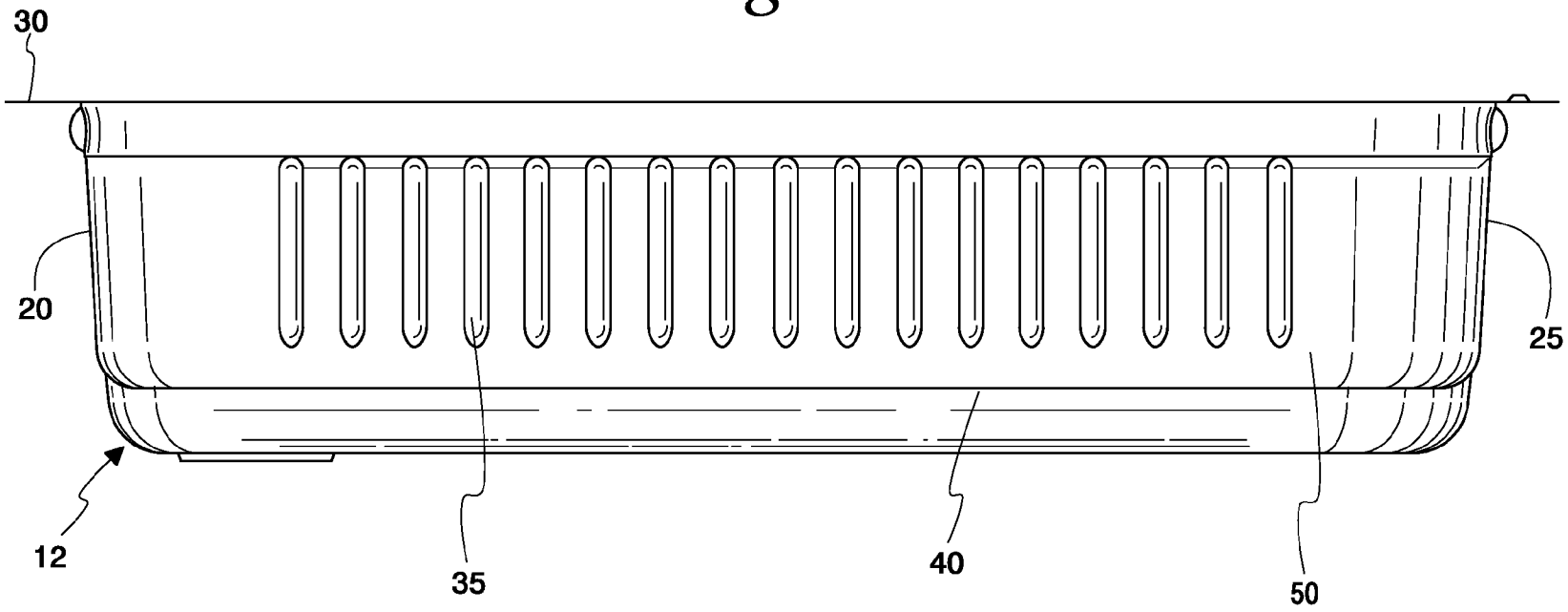
FIG. 2 displays a front view of the container of FIG. 1.
Figure 3:
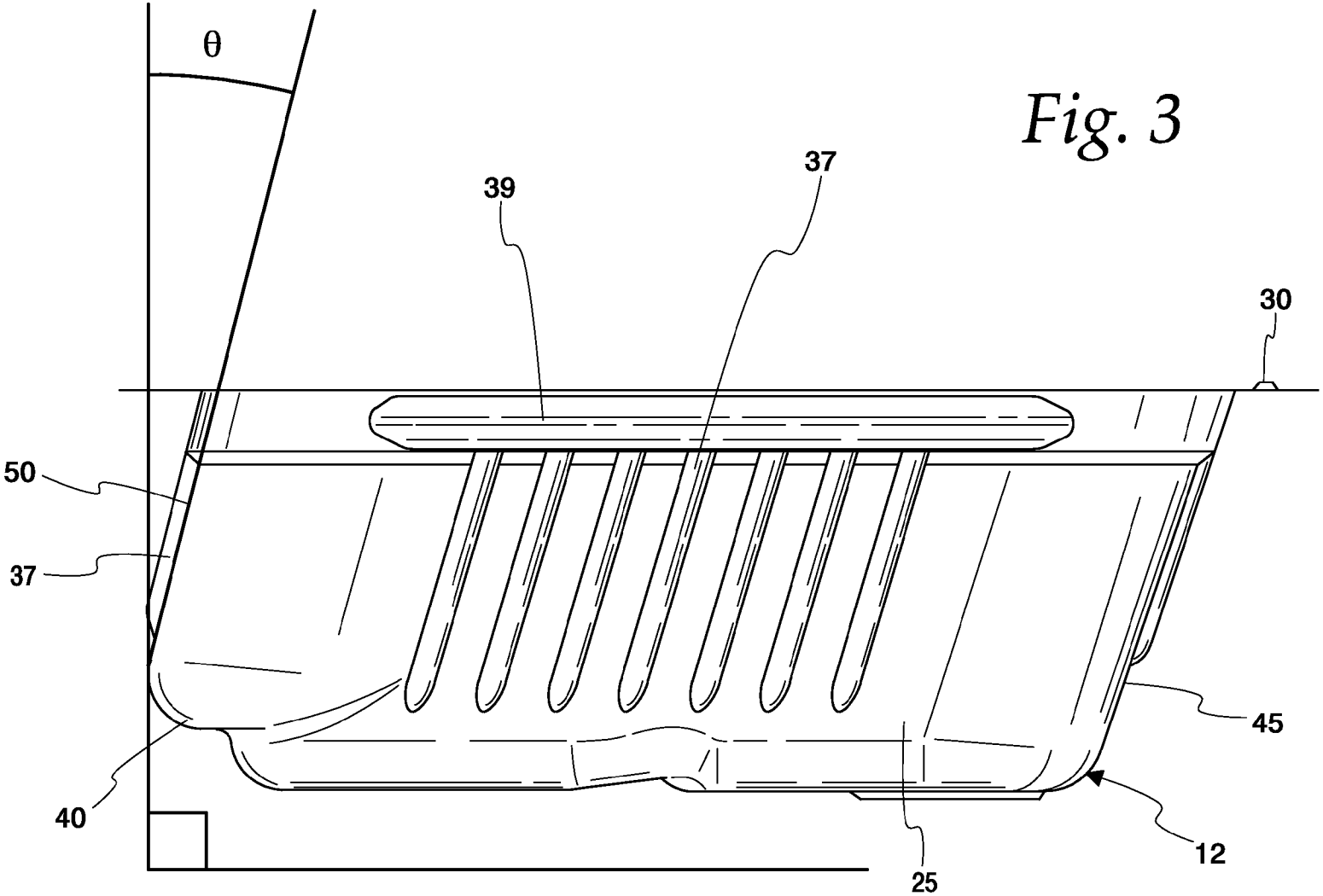
FIG. 3 displays a side view of the container of FIG. 1.

The container shown in this embodiment has four walls 20, 25, 45, 50 that extend roughly vertically relative to the base of the container 12 along its perimeter. Walls 20, 25, 45, 50 are integrally formed as shown in FIGS. 2 and 3. The relation of the walls to the base 12 of the container is depicted in FIGS. 2 and 3. The base 12 is integrally formed with walls 20, 25, 45, 50, thus making container 10. By way of example only, container 10 may be molded as a single piece using injection or vacuum molding, formed on a packaging machine, or other techniques known to those of skill in the art. FIG. 2 displays a view of the front of the container portion of the packages of the present invention. The two side walls 20, 25 extend substantially vertically from the base 12 as shown in FIG. 2. At the top of the walls 20, 25, 45, 50, a horizontal rim 30 extends roughly orthogonally from the walls. The walls 20, 25, 45, 50 may contain raised ribs 35 that add rigidity to the walls and overall strength to the container. FIGS. 2 and 3 also display a lip 40 formed in the front of the base 12 that is formed by a foot 65 present in the base of the container 10 (see FIG. 4) as described more fully hereinbelow.

Figure 3A:
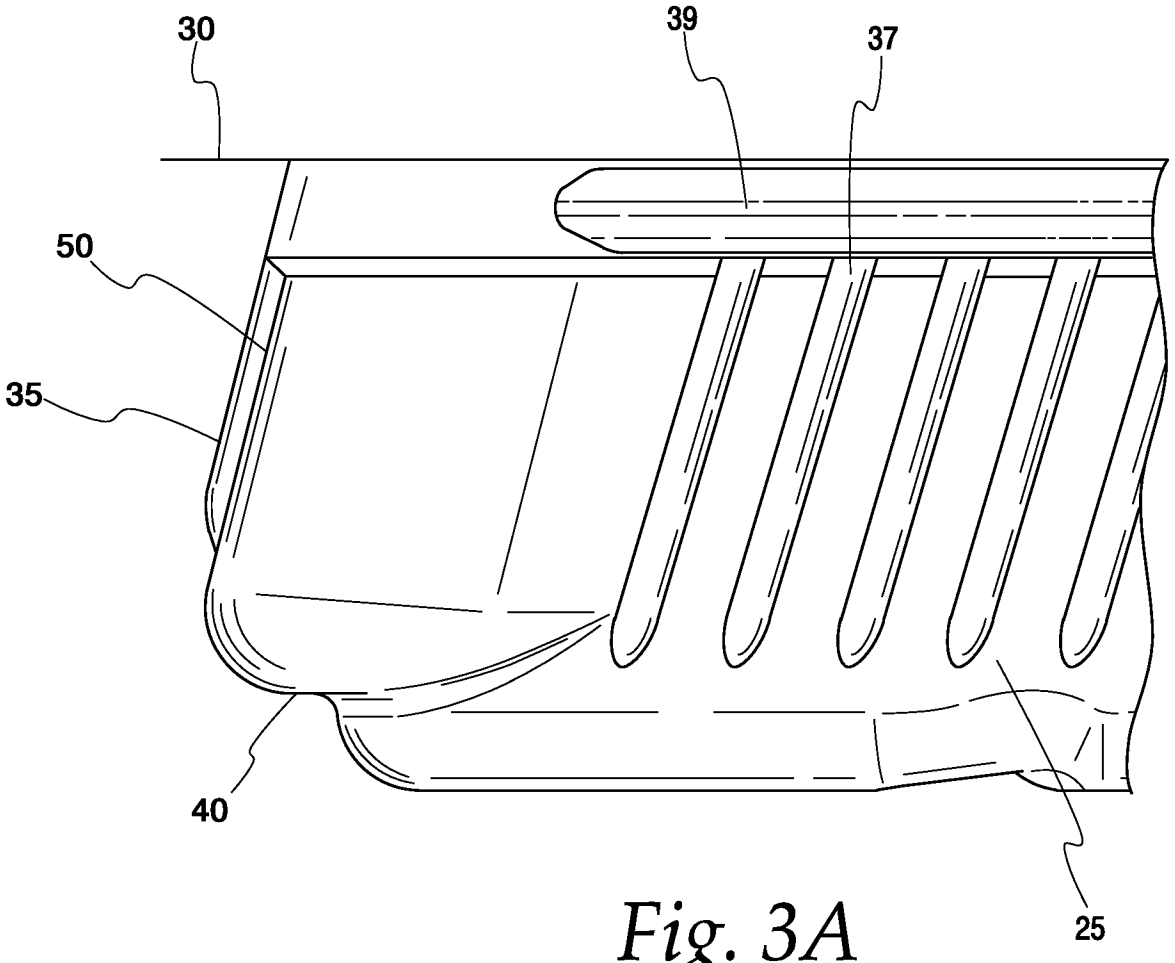
FIG. 3A displays an expanded view of the side of the container of FIG. 3.

FIG. 3 shows a side view of the container of the present invention. As is clearly observed in this view, the front wall 50 of the container is present at a negative angle θ relative to the base 12 of the container. The negative angle θ positions front wall 50 towards the center of the container and away from an imaginary vertical line extended perpendicularly from the perimeter of base 12 as shown in FIG. 3. Front wall 50 is substantially parallel to rear wall 45. This attribute of the present invention allows the packages of the present invention to rest stably in a near-vertical position as further described below. Angle θ shown in FIG. 3 may range from 10*o* to 25*o* with 14*o* presently preferred. The lip 40 at the front of the base 12 of the container is shown in side view and may be compared to the view of the front of lip 40 shown in FIG. 2. Ribs 37 may be formed in the side walls 20, 25 of the container 10 to add stability or aesthetic appeal to the container. Lid lock recess 39 may be formed in the top portion of container 10 at each end of container 10. Lid 15 engages lid lock recess 39, as will be described in further detail below, to form a snap fit so that the lid 15 re-closes the container 10. FIG. 3A is an expanded view of FIG. 3 showing the lid lock recess 39, ribs 37, front wall 50 and lip 40.

Figure 4:
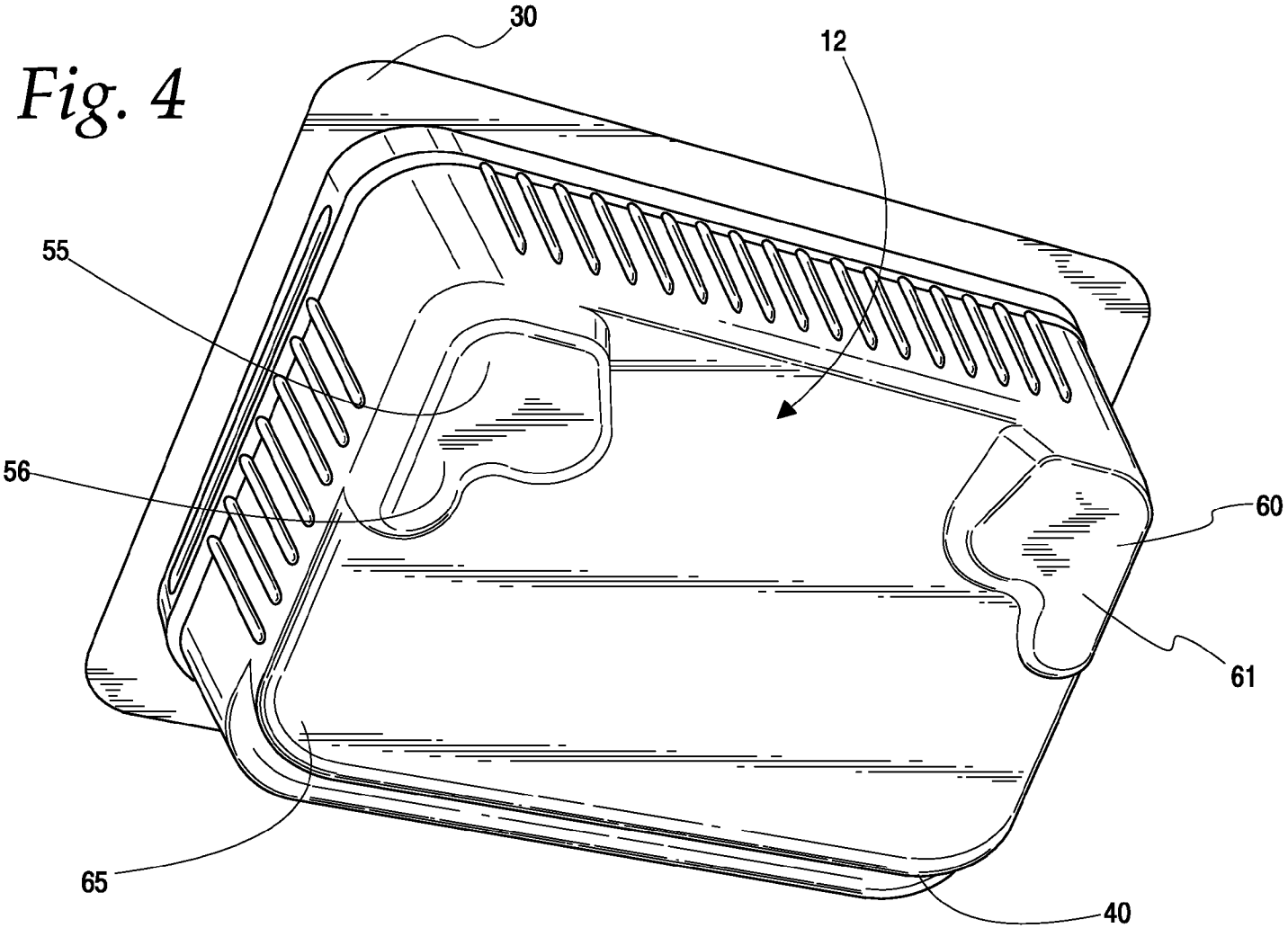
FIG. 4 depicts a bottom view of the container of FIG. 1.
Figure 5:
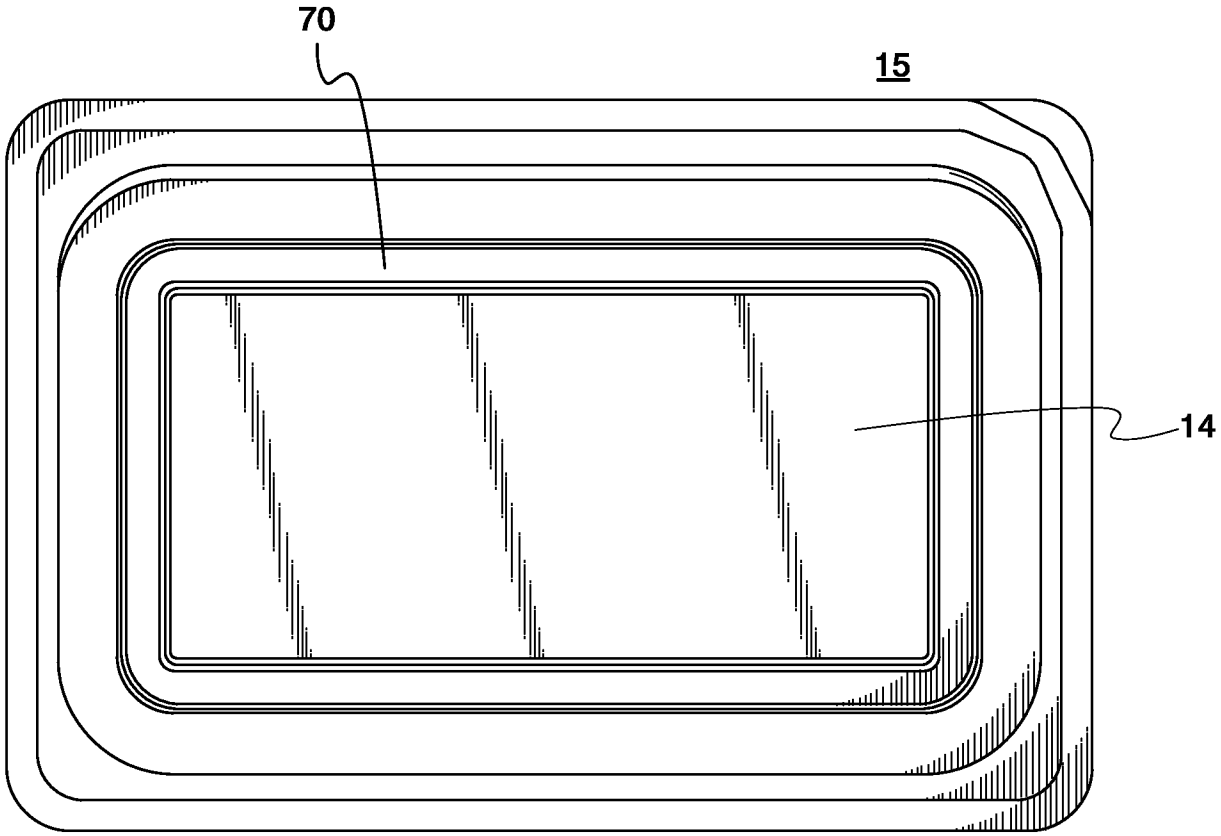
FIG. 5 shows the lid of FIG. 1.
Figure 7:
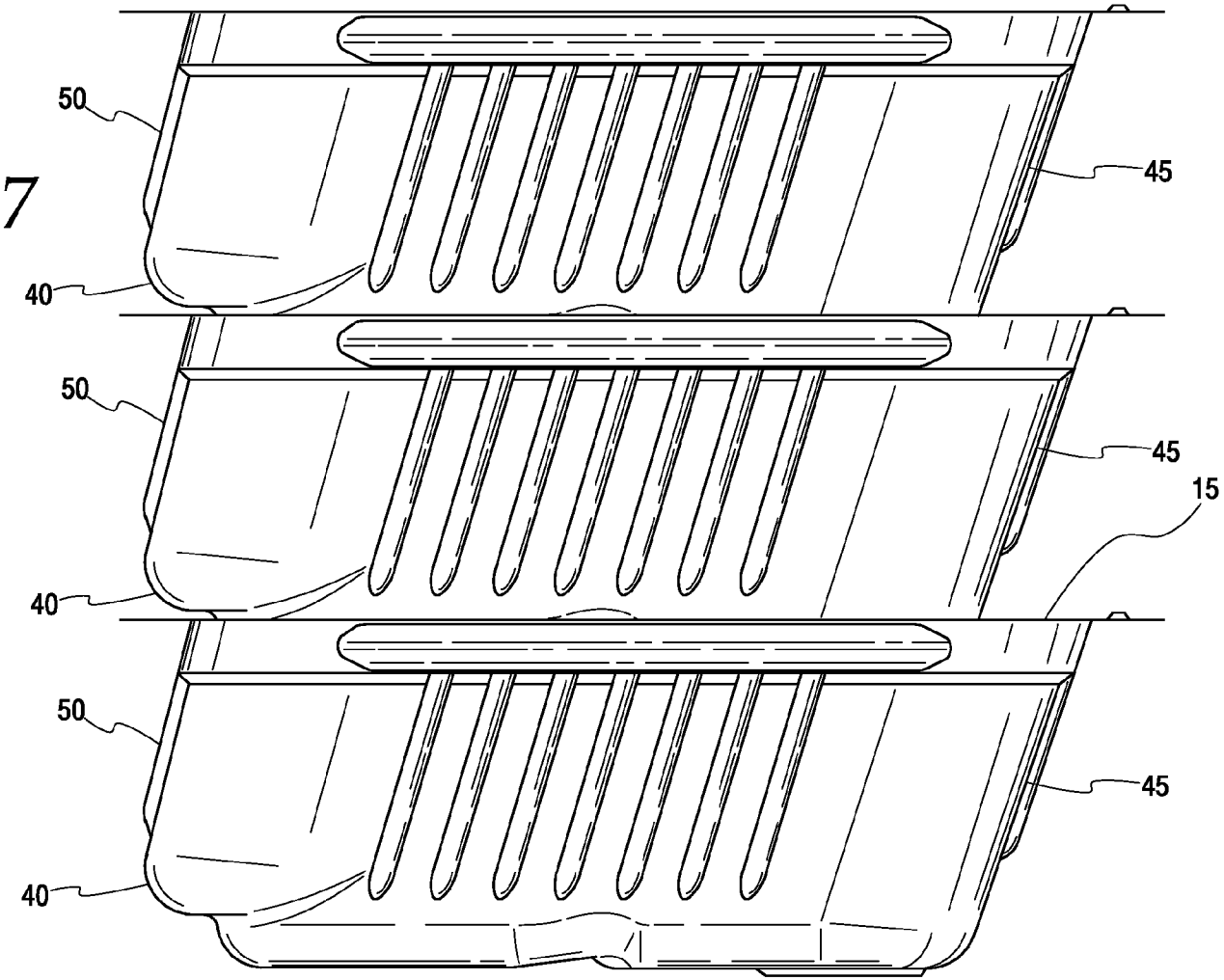
FIG. 7 shows stacking of the packages of FIG. 1.

FIG. 4 shows a bottom view of one embodiment of container 10 and depicts the location of feet 55, 60, 65 present in the base 12 of the container. In this embodiment, the base of the container includes three feet 55, 60, 65. The first two feet 55, 60 are located in the corners of the base 12 at the juncture of the rear and side walls. First two feet 55, 60 have substantially planar bottom surfaces 56 and 61 which form a bottom surface of the base 12. The third foot 65 extends along the entire length of the container at the front of the container. The third foot 65 is set back from the perimeter of the base 12 such that a lip 40 is formed at the front of the base, allowing for vertical stacking as shown in FIG. 7. The horizontal rim of the container 30 is sealed against the horizontal rim 32 of lid 15 (FIG. 5A) when the foodstuffs contained in container 10 are initially packaged. In the embodiment shown in FIG. 4, the third foot 65 runs parallel to the front perimeter of the base 12 as shown in FIG. 4. The particular geometry of the feet 55, 60, 65 may be varied while staying within the scope of the present invention depending on the aesthetic design to be achieved FIG. 5 depicts a bottom view of the lid 15 of the present invention. The lid 15 preferably fits snugly into the top of the container and may act to contain foodstuffs in the container. The lid 15 thus closes the container allowing any foodstuffs held in the container to remain fresh after initial opening of the packaging by the consumer. The lid 15 may include a recessed rib 70. Recessed rib 70 adds rigidity to the lid 15 and aids in locking the lid 15 in the lid lock recess 39 (FIG. 3) when the lid 15 is used to re-close container 10.

Figure 5A:
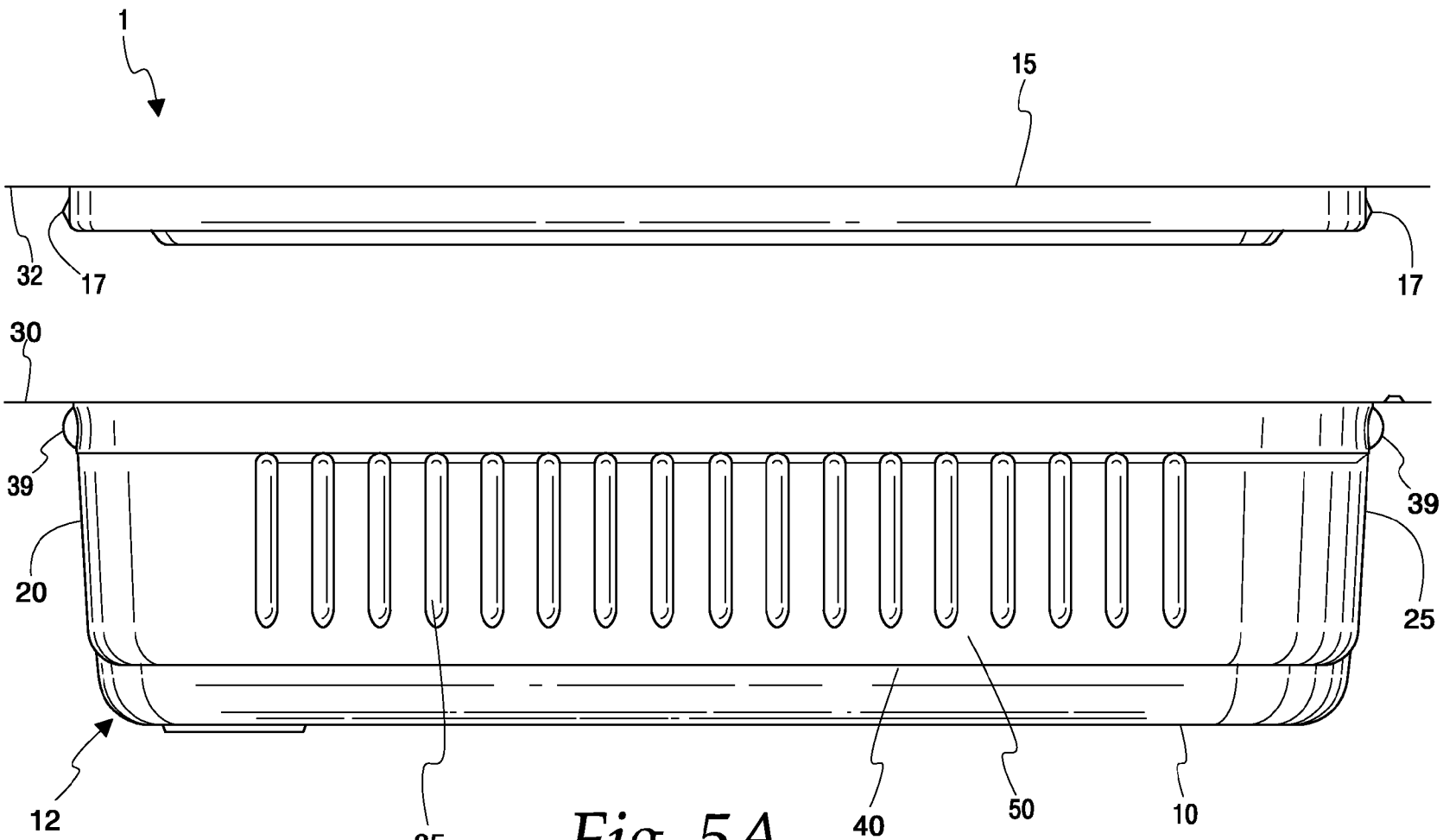
FIG. 5A shows a front view of the container and lid of FIG. 1.

FIG. 5A presents a front view of lid 15 and container 10 and further illustrates the structural elements of package 1 which function to seal and re-close lid 15 to container 10. During initial packaging of the foodstuffs which are contained in container 10, the horizontal rim 32 of the lid 15 is sealed against the horizontal rim 30 of the container thus helping to maintain the freshness of the foodstuffs. Lid 15 may include a locking member 17 disposed at opposite ends of lid 15. After the package 1 is opened by a consumer, a locking member 17 may be engaged in a locking recess 39 so that lid 15 snap-fits to container 10 and re-closes container 10 thus helping to maintain the freshness of the foodstuffs.

Figure 6:
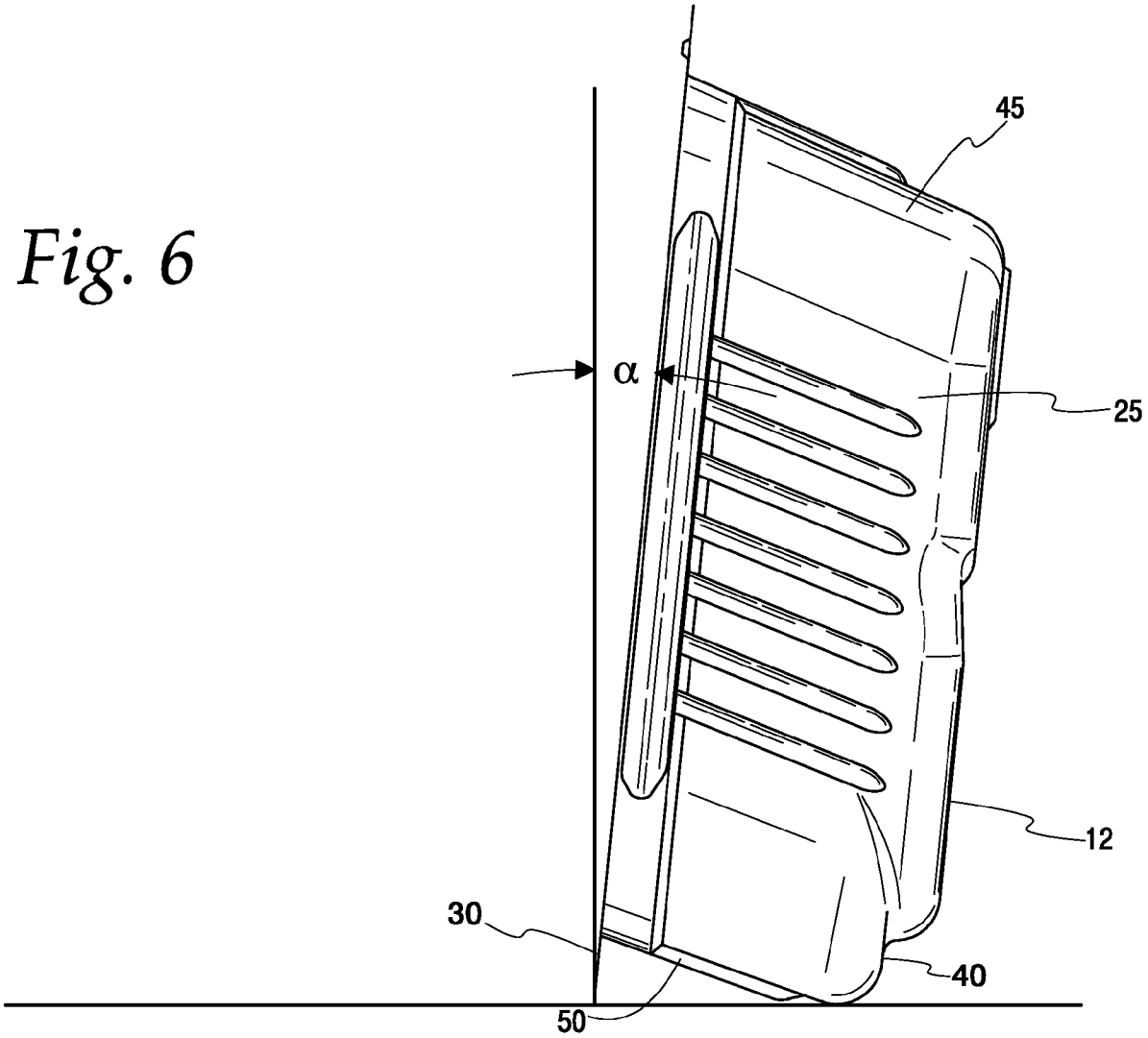
FIG. 6 depicts the package of FIG. 1 as it might be displayed on a shelf in a store in a near-vertical orientation.

The geometrical configuration of the packages of the present invention allows the packages to be stacked in a variety of manners for display in and shipping to stores. For display, the package may be positioned such that the front wall 50 of the container faces the shelf surface. While in this position, the packages of the present invention possess a center of mass that is substantially directly above the front wall 50 of the container. The center of mass of the package is located substantially directly above the front wall of the container because of the angle θ of the front wall 50. In this orientation, the container will rest stably on the horizontal rim 30 that runs along the front of the container and the front wall 50 as shown in FIG. 6. When placed in this orientation, the novel geometry of the containers of the present invention allows the packages to be maintained in a position where the face of the container is preferably less than six degrees away from vertical as shown in FIG. 6. Thus, the combination of the horizontal rim, the lip, and the negative angle of the front wall allows the packages of the present invention to maintain a near-vertical positioning stably.

This attribute of the present invention provides a significant advantage over prior art packages that seek to maintain the look and appearance of foodstuffs located in the container. In many of the prior art packages, the shape and configuration of the package is designed emphasizing the display of the foodstuffs and the maintenance of a fluffed appearance of the package contents. However, movement of the foodstuffs during transportation of the packages may result not only in a loss of fluffed appearance, but also instability of the package when it is placed in a near-vertical orientation. In contrast, the packages of the present invention may be displayed stably in a near-vertical orientation so that the face of the package may easily be observed by consumers in the store.

In this embodiment, lid 15 holds the contents of the package in place. In alternative embodiments, the contents of the container 10 are enclosed in an inner package or bag (not shown). The use of an inner package or bag may also help to minimize movement of the contents during shipping and handling. This attribute of the present invention also allows the efficient vertical stacking of the packages and allows the maintenance of a substantial inventory of the packages on the store shelves which are convenient to access.

The packages of the present invention may also be stacked in a horizontal position as shown in FIG. 7. The lip 40 in the base 12 of the container fits complementarily into the recessed portion 14 of the lid 15 of another package of the present invention so as to allow stacking of the packages. The lip 40 provides stability to the overall stack by stabilizing the interaction between two adjacent packages. Because the lip 40 results in the third foot 65 being set back from the perimeter of the container, packages of the present invention are able to be stacked in a stable vertical column even though the front and rear walls are angled as described above.

Figure 8:
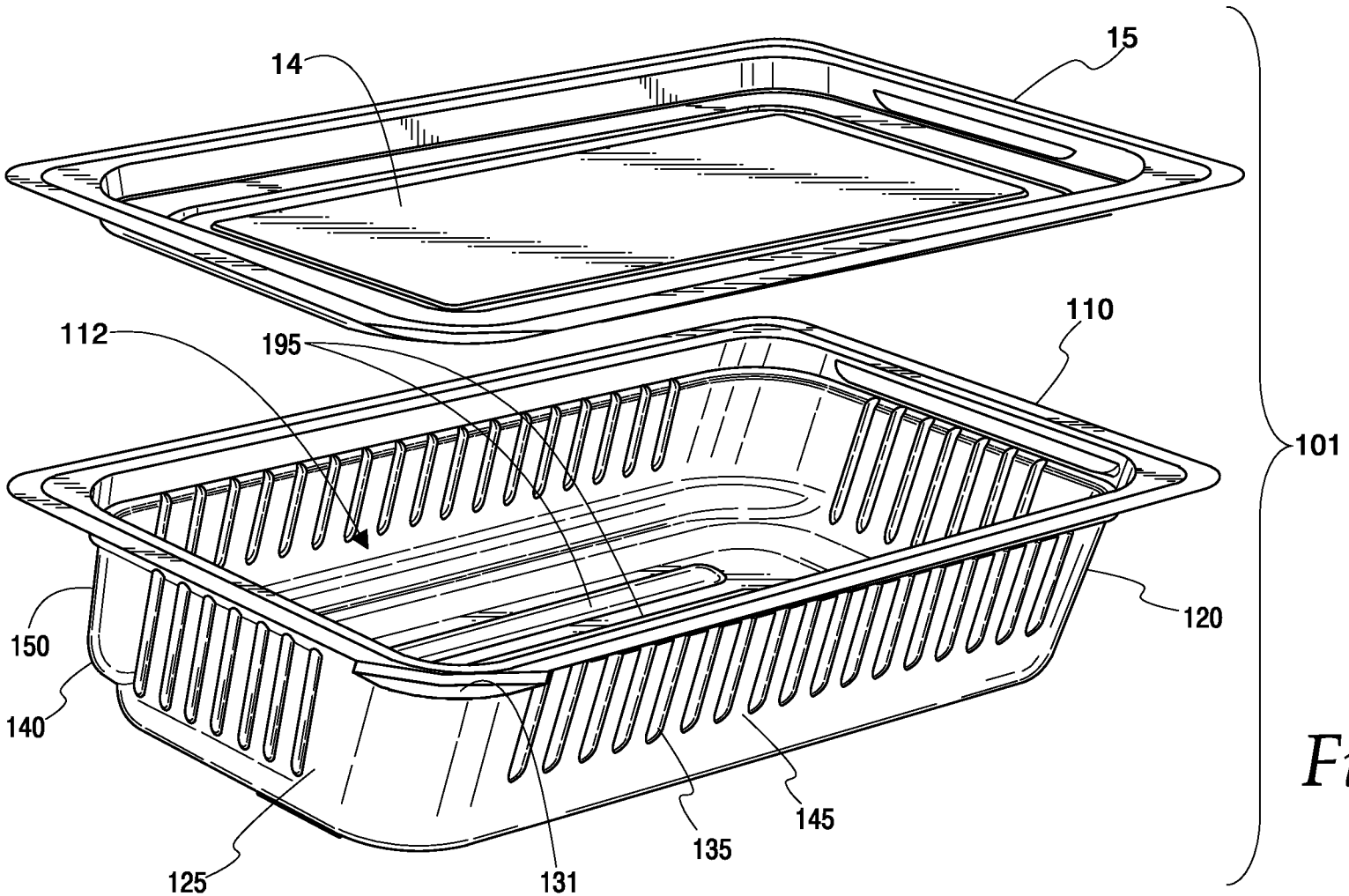
FIG. 8 shows a profile view of a second embodiment of a package, including a container and lid, of the present invention.

A second embodiment of the present invention is shown in FIG. 8. Like the prior embodiment, the package 101 includes a container 110 and a lid 15. (Lid 15 is the same as the lid of container 10).

Figure 9:
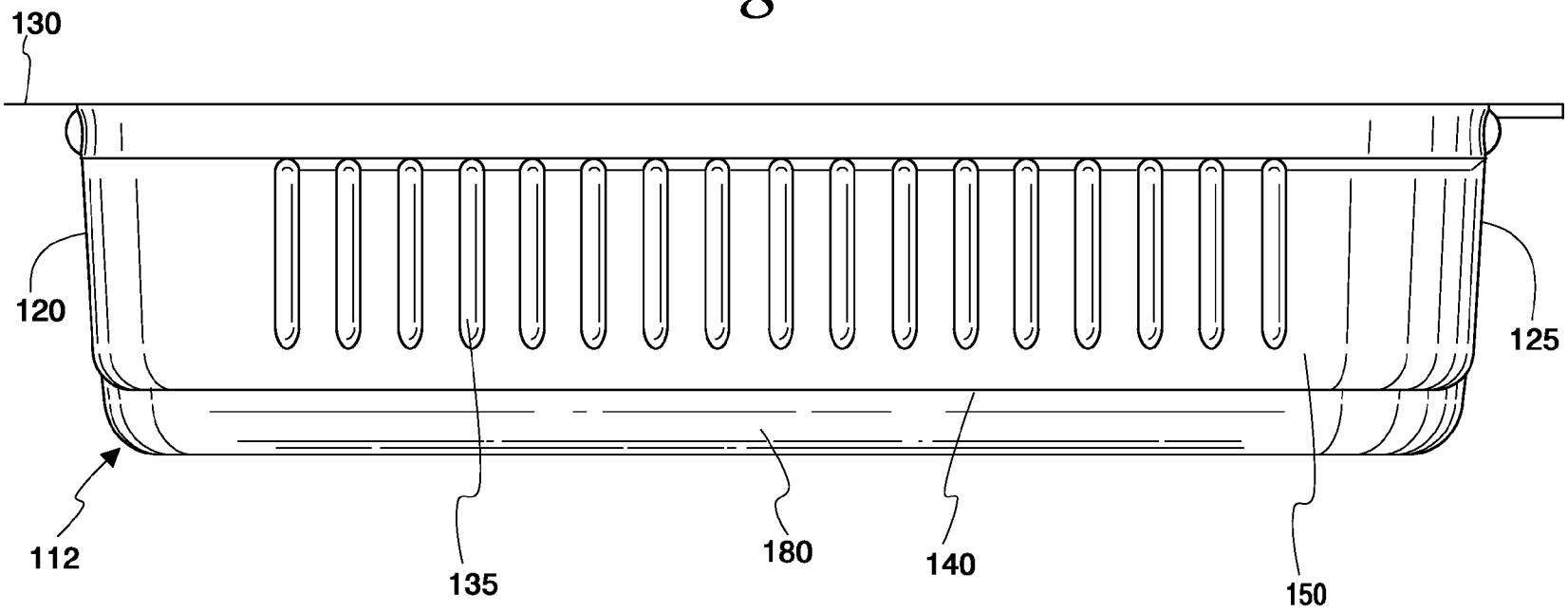
FIG. 9 displays a front view of the container of FIG. 8.
Figure 10:
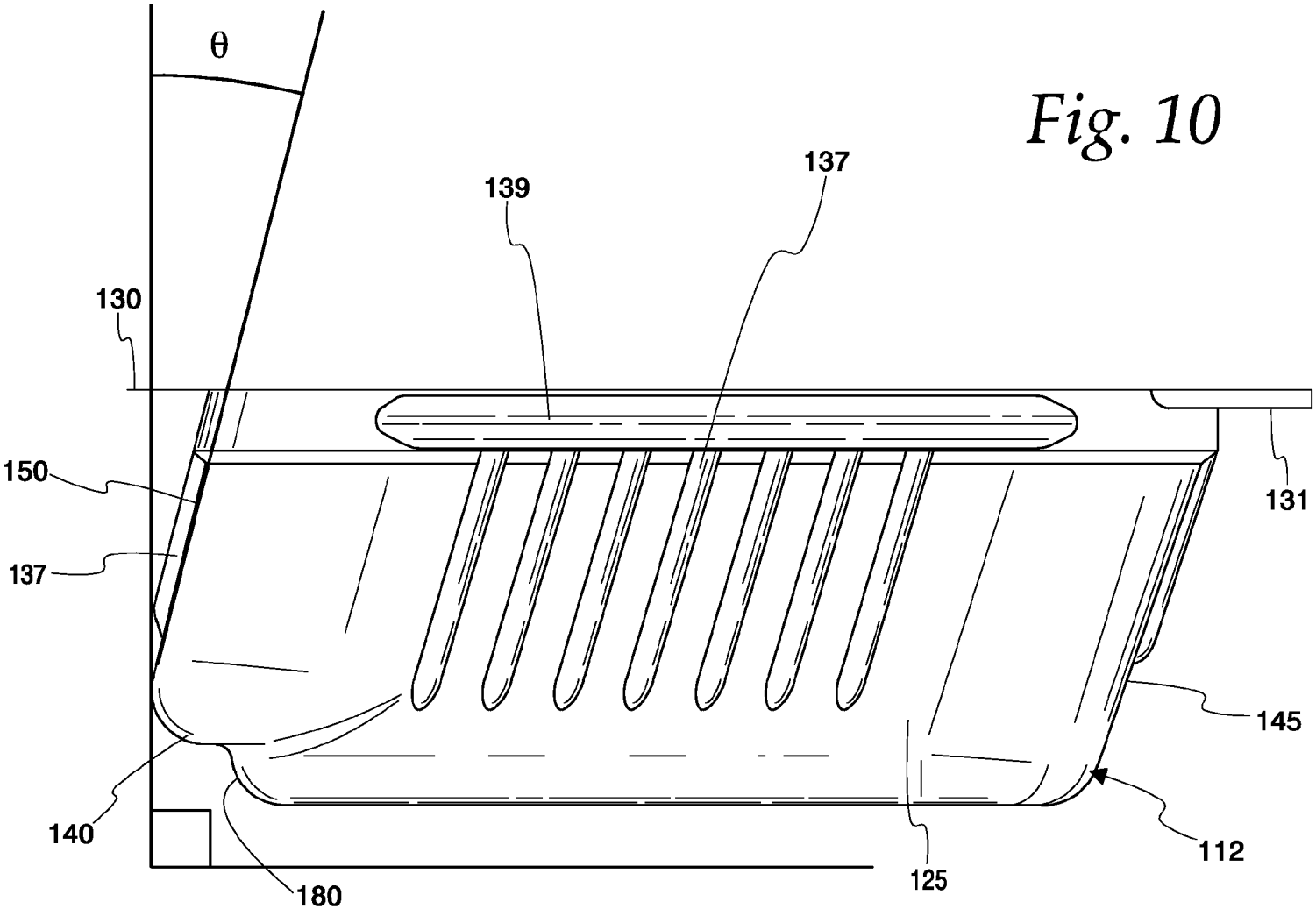
FIG. 10 displays a side view of the container of FIG. 8.

The container of this embodiment has four walls 120, 125, 145, 150 that extend roughly vertically relative to the base of the container 112 along its perimeter. Walls 120, 125, 145, 150 are integrally formed as shown in FIGS. 9 and 10. The relation of the walls to the base 112 of the container is depicted in FIGS. 9 and 10. The base 112 is integrally formed with walls 120, 125, 145, 150, thus making container 10 and defining an interior compartment of the container. FIG. 9 displays a view of the front of the container portion of the package. The two side walls 120, 125 extend substantially vertically from the base 112 as shown in FIG. 9. At the top of the walls 120, 125, 145, 150, a horizontal rim 130 extends roughly orthogonally from the walls. The walls 120, 125, 145, 150 may contain raised ribs 135 that add rigidity to the walls and overall strength to the container. FIGS. 9 and 10 also display a lip 140 formed in the front of the base 112 that is formed by a front edge 180 of the base 112 of the container 110 (see FIG. 10A) as described more fully hereinbelow.

FIG. 10 shows a side view of the container 110. As with the prior embodiment, the front wall 150 of the container is sits at a negative angle θ relative to the base 112 of the container. The negative angle θ positions the top portion front wall 150 towards the center of the container and away from an imaginary vertical line extended perpendicularly from the perimeter of base 112 as shown in FIG. 10. Front wall 150 is substantially parallel to rear wall 145. This attribute of the present invention allows the packages of the present invention to rest stably in a near-vertical position as further described below. Similar to the prior embodiment, angle θ shown in FIG. 10 may range from 10*o* to 25*o* with 14*o* presently preferred. The lip 140 is shown in side view and may be compared to the view of the front of lip 140 shown in FIG. 9. Ribs 137 may be formed in the side walls 120, 125 of the container 110 to add stability or aesthetic appeal to the container. A lid lock recess 139 may be formed in the top portion of container 110 at each end of container 110. Lid 15 engages lid lock recess 139, as will be described in further detail below, to form a snap fit so that the lid 15 re-closes the container 110.

Figure 10A:
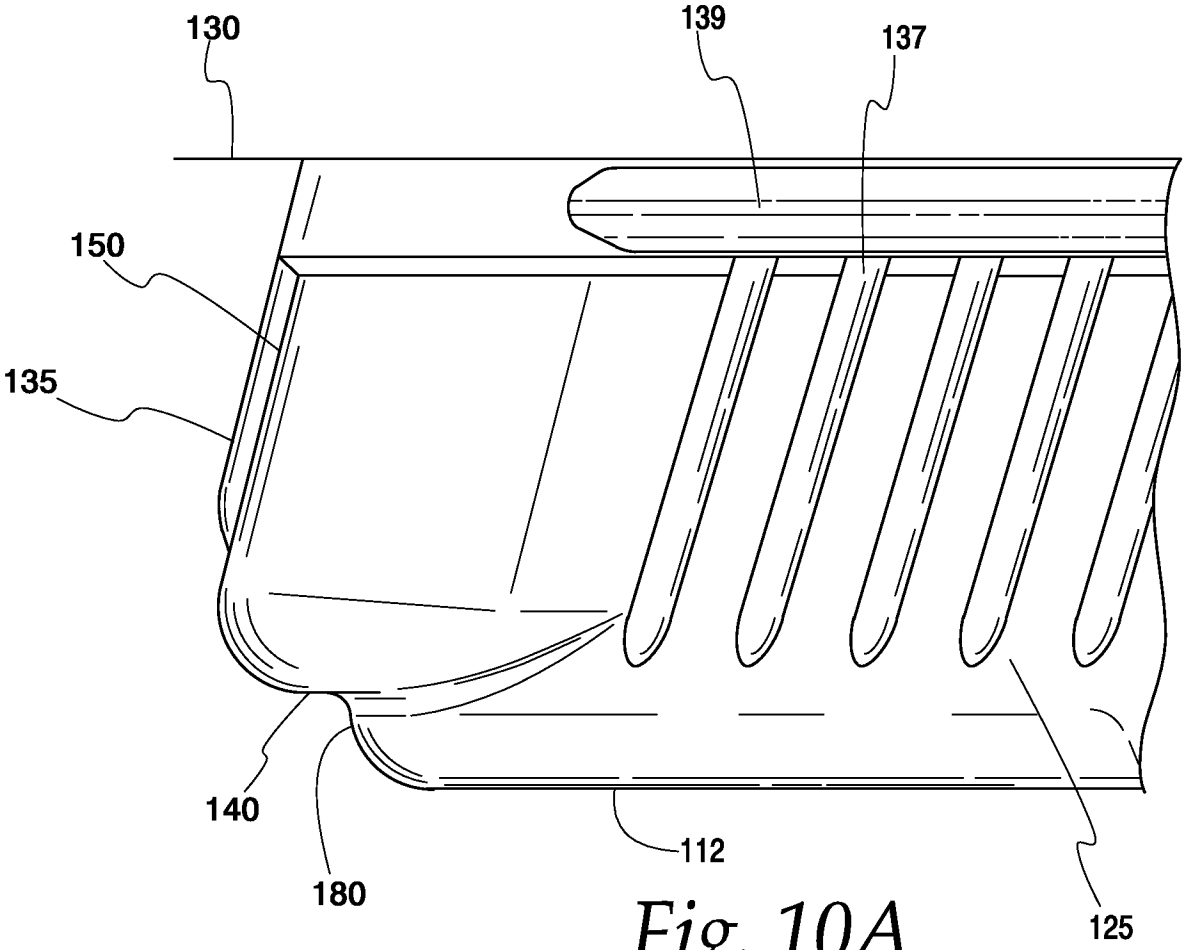
FIG. 10A displays an expanded view of the side of the container of FIG. 8.

FIG. 10A is an expanded view of FIG. 10 showing the lid lock recess 139, ribs 137, front wall 150 and lip 140. As shown in FIGS. 10 and 10A, base 112 has a front edge 180 adjacent lip 140. Front edge 180 extends generally perpendicular to the bottom surface 185 of the container base 112.

Figure 11:
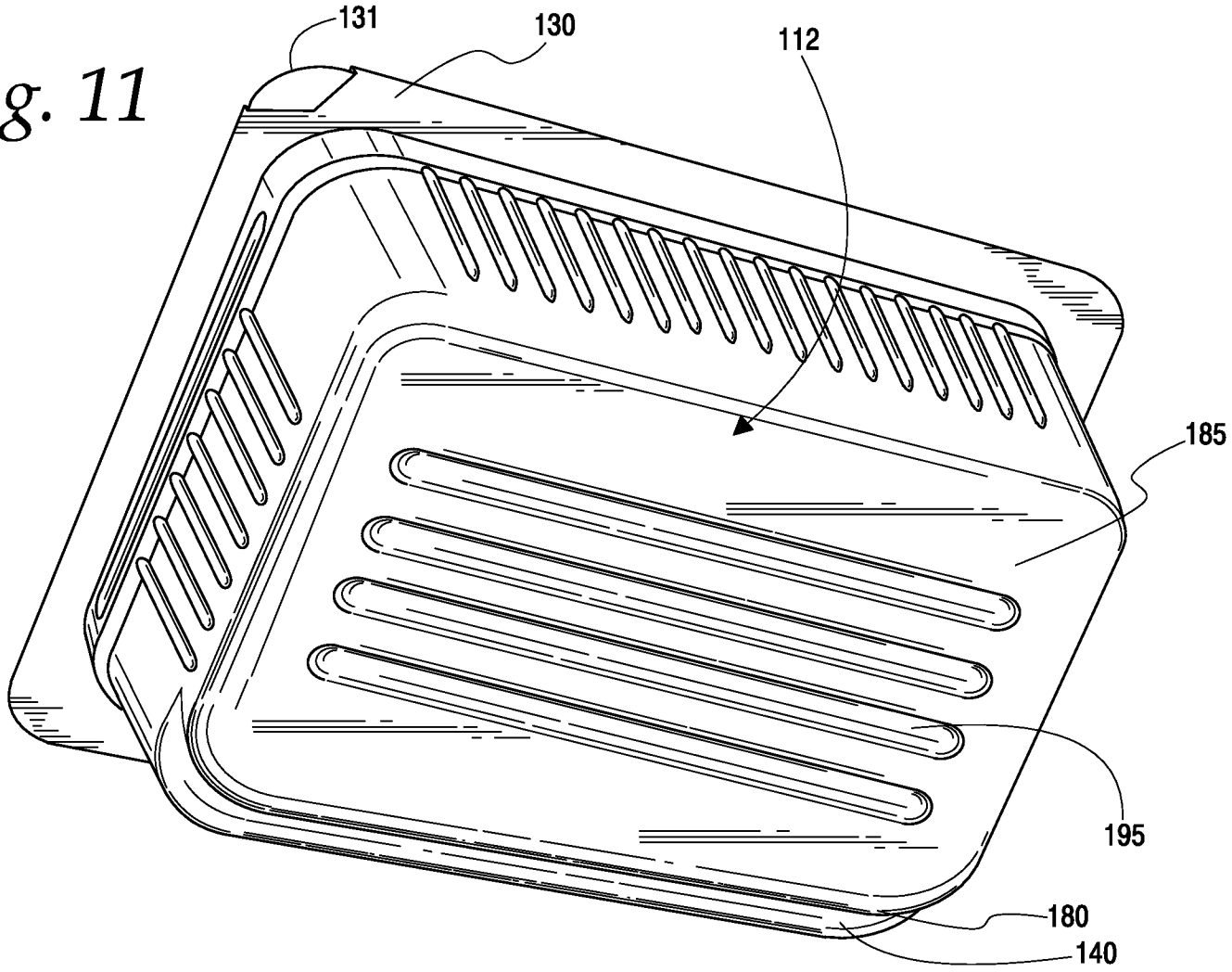
FIG. 11 depicts a bottom view of the container of FIG. 8.
Figure 12:
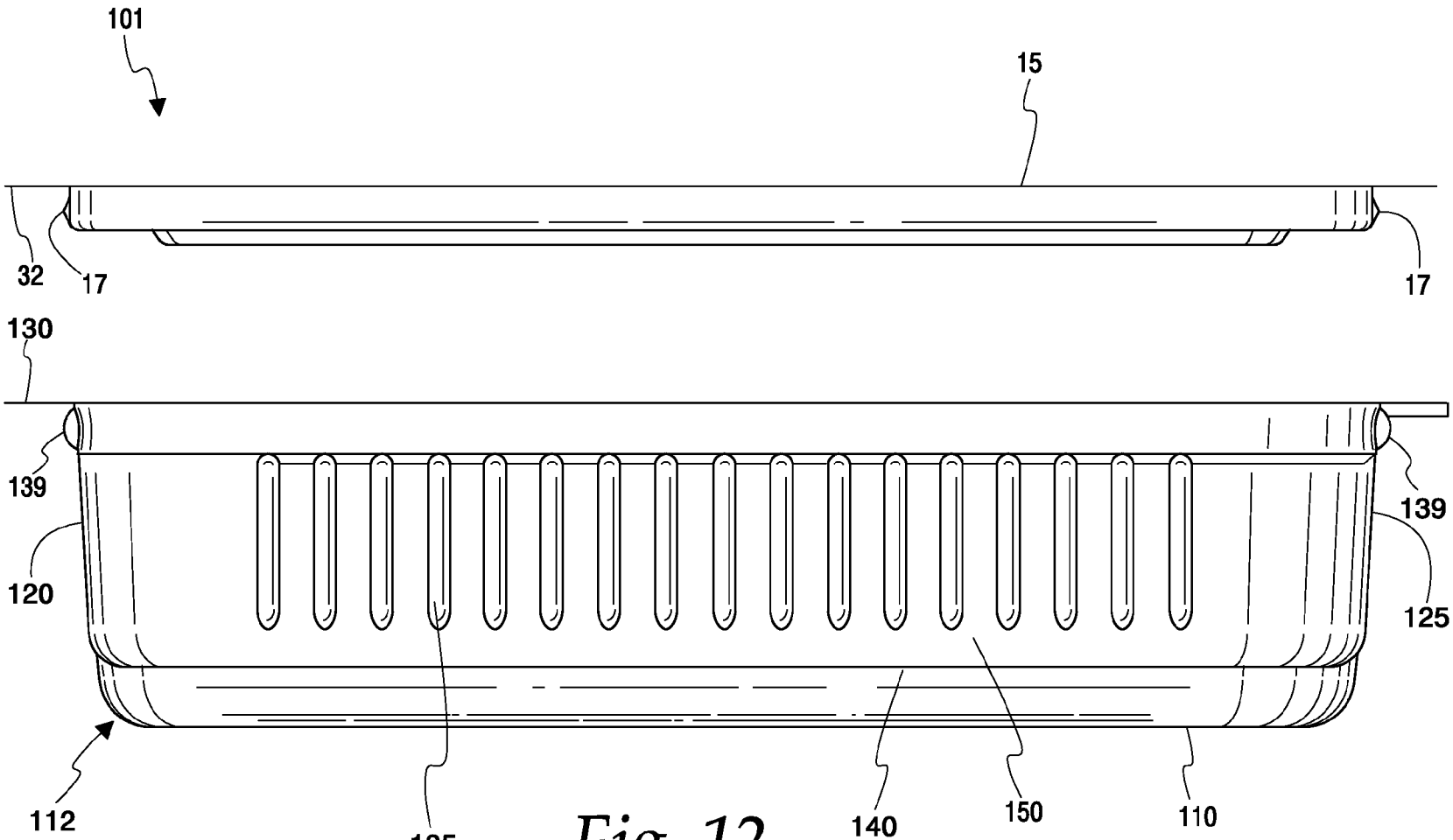
FIG. 12 shows a front view of the container and lid of FIG. 8.
Figure 13:
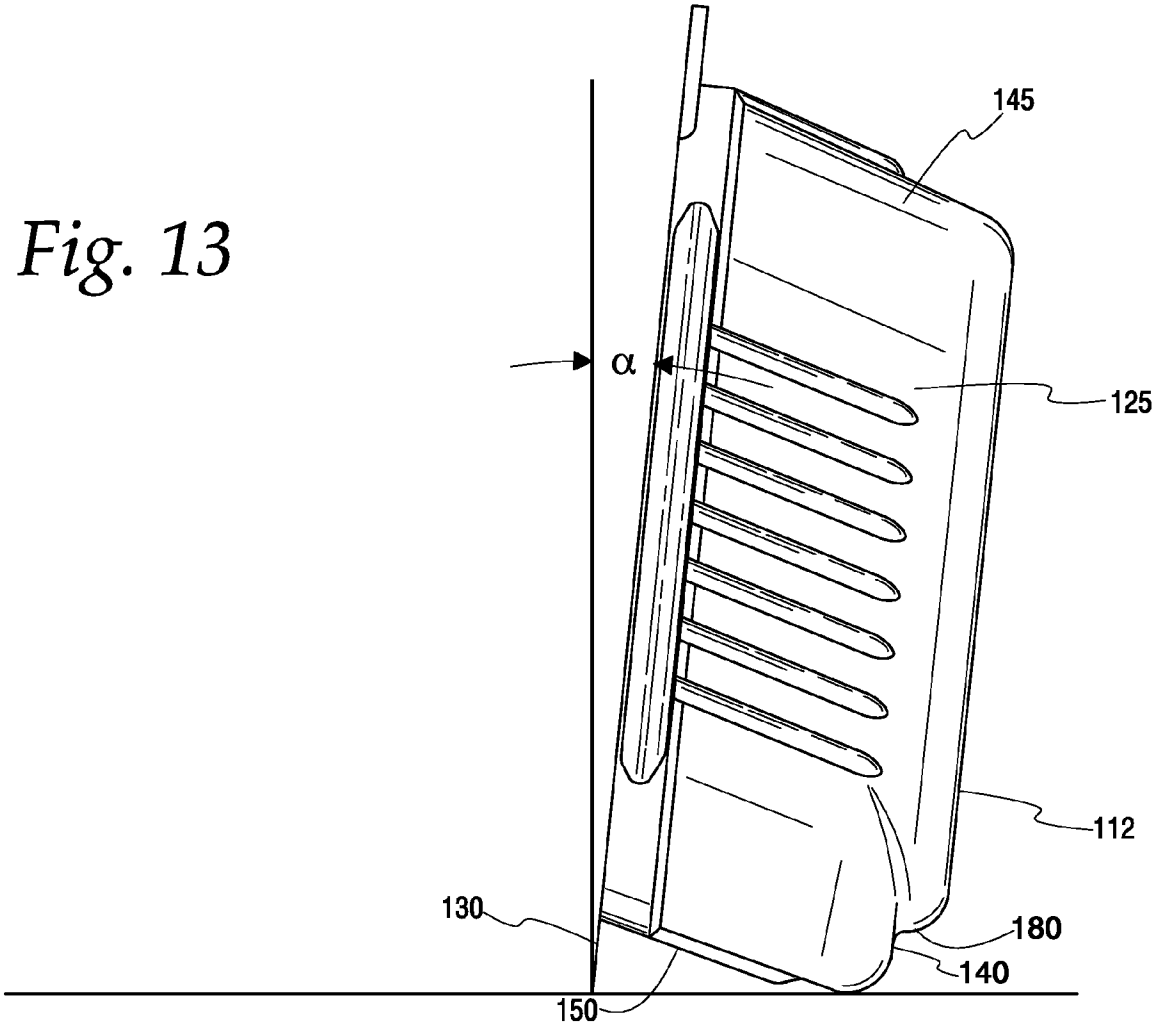
FIG. 13 depicts the package of FIG. 8 as it might be displayed on a shelf in a store in a near-vertical orientation.

FIG. 11 shows a bottom view of one embodiment of container 110. In contrast to the prior embodiment, container 110 has a base 112 that has a mostly flat bottom surface 185 that is generally coplanar and generally parallel to lid 15 (shown in FIG. 1). Bottom surface 185 may include ribs 195. The bottom surface 185 ends prior to reaching the frontmost portion of wall 150 and transitions to front edge 180, which transitions to lip 140. The front edge 180 and the lip 140 form a step in the front portion of the base and allow for vertical stacking as shown in FIG. 13. The horizontal rim 130 of the container is sealed against the horizontal rim 32 of lid 15 (FIG. 12) when the foodstuffs contained in container 110 are initially packaged.

Horizontal rim 130 includes a thumb well feature 131, as shown in FIGS. 8, 10, 11. Thumb well 131 is at a corner of the horizontal rim 130. The Thumb well feature 131 comprises a portion of the rim that is recessed downward from the rest of the rim 130 relative to and towards the base 195. This feature creates a space between the portion of the horizontal rim 130 forming the thumb well 131 and the horizontal rim 32 of the lid 15. This space allows a user to insert a thumb or finger between the horizontal rim 130 and the horizontal rim 32 of lid 15 to separate the lid 15 from the container.

Similar to the prior embodiment, the geometrical configuration of the package 101 allows the packages to be stacked in a variety of manners for display in and shipping to stores. For display, the package may be positioned such that the front wall 150 of the container faces the shelf surface, as shown in FIG. 13. While in this position, the packages of the present invention possess a center of mass that is substantially directly above the front wall 150 of the container. The center of mass of the package is located substantially directly above the front wall of the container because of the angle θ of the front wall 150. In this orientation, the container will rest stably on the horizontal rim 130 that runs along the front of the container and the front wall 150 as shown in FIG. 13. When placed in this orientation, the novel geometry of the containers of the present invention allows the packages to be maintained in a position where the face of the container is preferably less than six degrees away from vertical as shown in FIG. 13. Thus, the combination of the horizontal rim, the lip, and the negative angle of the front wall allows the packages of the present invention to maintain a near-vertical positioning stably.

Figure 14:
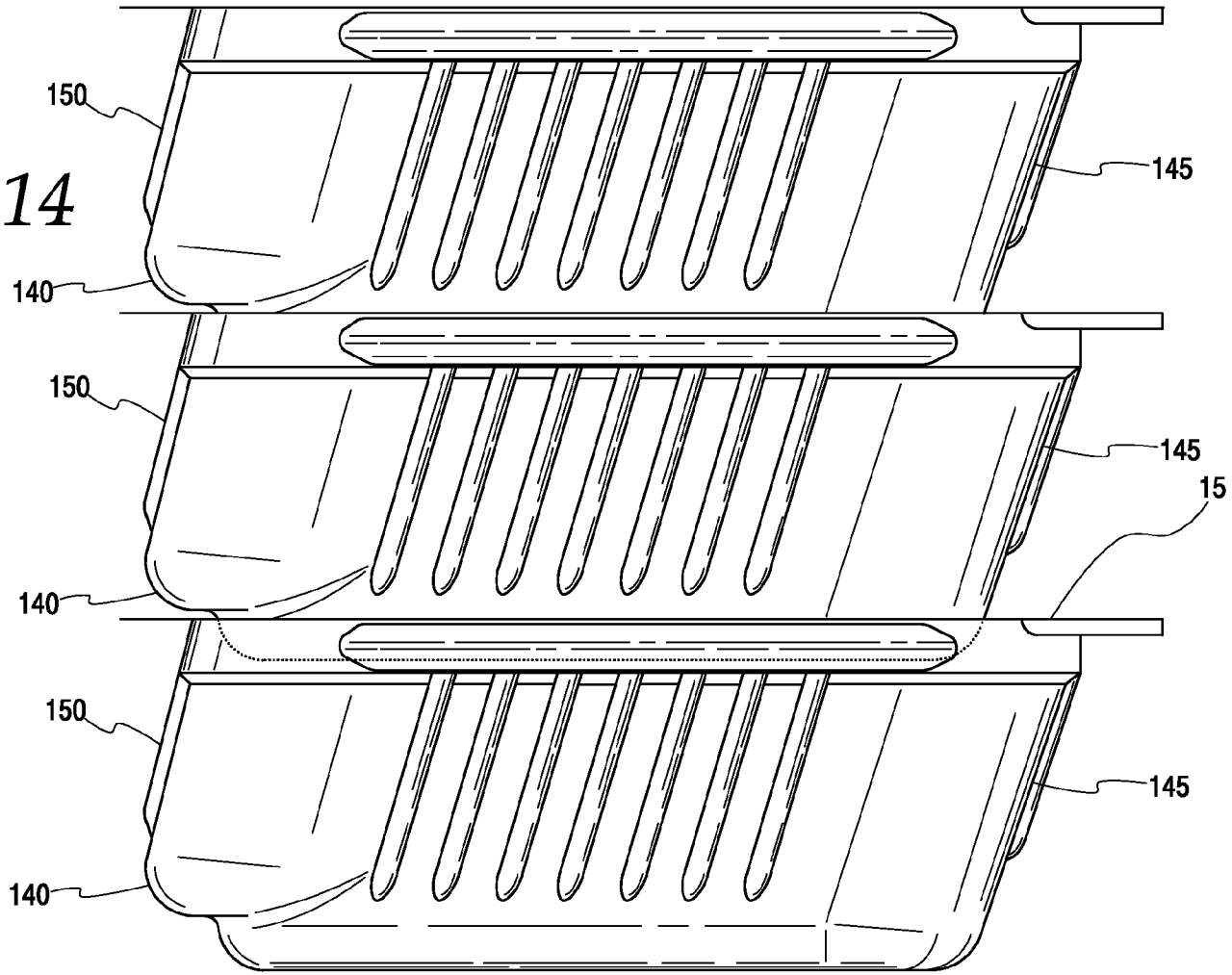
FIG. 14 shows stacking of the packages of FIG. 8.

Packages 101 may also be stacked, nesting together in a horizontal position as shown in FIG. 14. The front edge 180 of the base 112 of the container preferably fits complementarily into the lid 15 of another package 101 so as to allow stacking of the packages in a nested configuration. The nesting provides additional stability to the overall stack by stabilizing the interaction between two adjacent packages. Because the lip 40 results in the front edge 180 being set back from the perimeter and wall 150 of the container, packages 101 are able to be stacked in a stable vertical column even though the front and rear walls are angled as described above.

Figure 15:
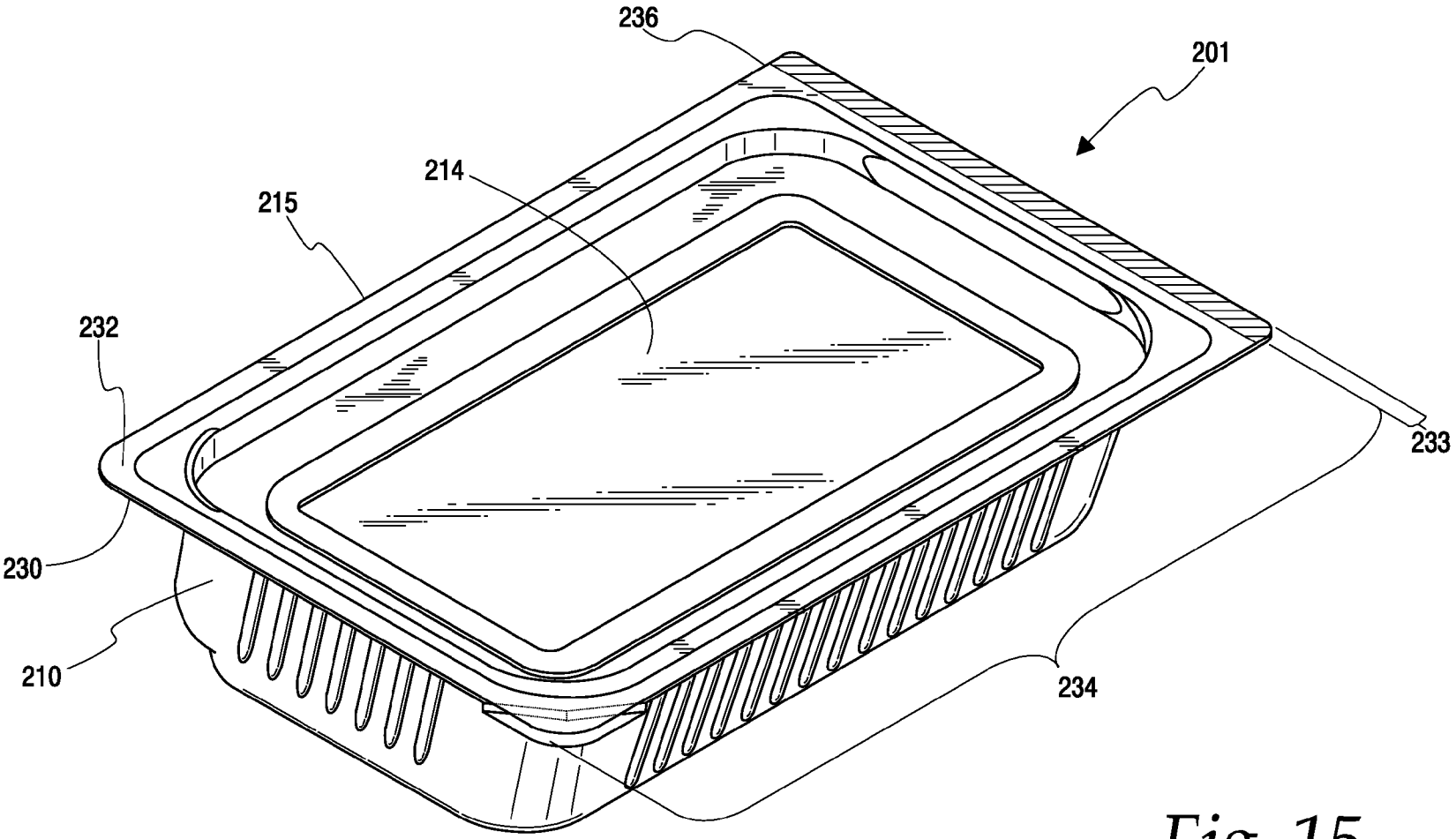
FIG. 15 shows a profile view of a third embodiment of a package of the present invention, in which the lid is hingedly attached to the container.
Figures 16, 16A:
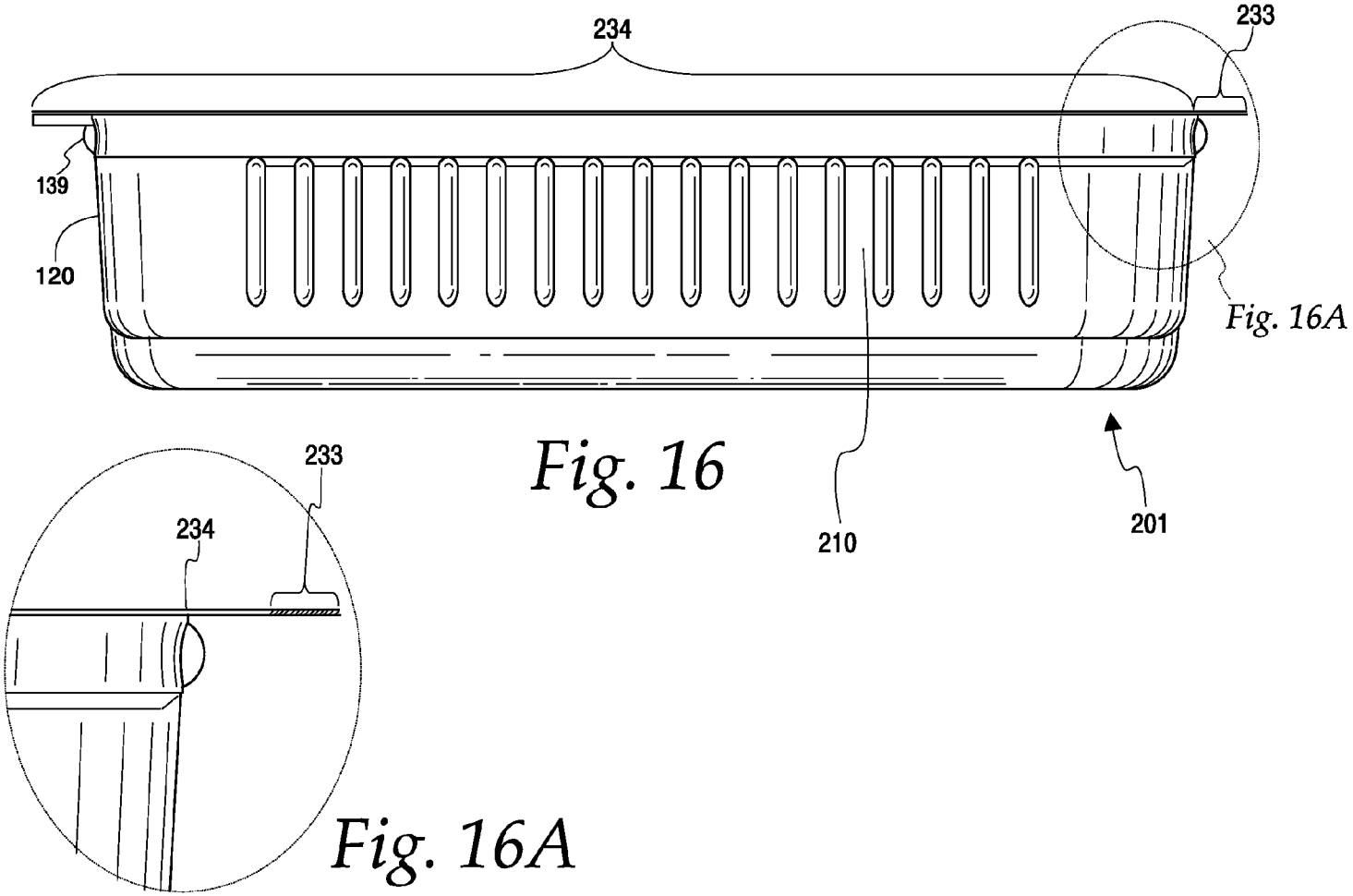
FIG. 16 displays a side view of the container of FIG. 15.
FIG. 16A displays a partial side view of the container of FIG. 15.

A third embodiment of the package 20 is shown in FIGS. 15-16A. Package 201 has a lid 215 that has a hinge dividing a first portion of the lid 215 that opens and detaches from container 210 and a second portion of lid 215 that remains sealed to container 210. Lid 215 hinges at the intersection of the first portion 233 and the second portion 234. Like the prior embodiment lid 15, this lid 215 also includes a central recessed portion 214 which is sized and shaped to receive the base of a second identical container to allow stacking. Except as described below, package 201 is identical to package 101.

Lid 215 has a rim 232 around its outer perimeter. Rim 232 has a generally flat surface that engages horizontal rim 230 of container 210. A first portion of the rim 233 is hard-sealed or non-removably connected to horizontal rim 230. A second portion of the rim 234 is releasably sealed to rim 230. When a customer first opens the package, he or she will peel the second portion of the rim 234 of the lid furthest from the first portion 233 in a direction away from the container 210, so that the first portion releases from the container and the lid flexes where the hard sealed first portion 233 begins, thereby creating a hinge in the lid. The lid can be resealed to the container by bending it at the hinge back toward the container. Lid 215 has snap fit features similar to lid 15, described above, which re-close the container 210.

Nothing in the above description is meant to limit the present invention to any specific materials, geometry, or orientation of elements. Many modifications are contemplated within the scope of the present invention and will be apparent to those skilled in the art. The embodiments described herein were presented by way of example only and should not be used to limit the scope of the invention.

What is claimed is:

1. A package for containing a foodstuff, comprising:

a container comprising a base having a perimeter and a bottom surface, a front wall, a rear wall, a first side wall and a second side wall, wherein the side walls extend substantially vertically from the perimeter at opposite sides of the base, further wherein the front wall and the rear wall extend from the perimeter at opposite sides of the base, further wherein the front wall extends at a negative angle relative to the bottom surface of the base towards a center of the container;

the container further comprising a substantially horizontal rim disposed along a portion of the front wall, the rear wall, the first side wall, and the second side wall opposite to the base;

a lip formed in the base proximate the front wall;

an outward facing front edge formed in the base and extending generally perpendicular to the bottom surface of the base;

wherein the front portion of the horizontal rim and the lip are adapted to rest on a horizontal surface when said package is in a near-vertical position, further wherein a center of mass of the package to be located above the front wall when the package is in the near-vertical position; and a lid having a recessed top surface, wherein the lid fits into the rim to contain the foodstuff placed in the container;

wherein the bottom surface of the base and the front edge of the base fit stably in the recessed top surface of the lid of a second identical package to allow stable vertical stacking of a plurality of the packages.

2. The package of claim 1, wherein the negative angle relative to the bottom surface of the base is between about 10 degrees and about 25 degrees relative to a vertical axis.

3. The package of claim 2, wherein the negative angle relative to the bottom surface of the base is approximately 14 degrees relative to a vertical axis.

4. The package of claim 1, further comprising a horizontal rim on the lid, wherein the lip of a second identical package rests on the horizontal rim of the package when the second identical package is nested into the recessed portion of the lid.

5. The package of claim 1, wherein the side, front, and rear walls include a plurality of ribs.

6. The package of claim 1, wherein the lid includes a recessed rib that is parallel to the rim towards a center of the lid and which adds rigidity to the lid.

7. The package of claim 1, wherein said package is at an angle less than six degrees from vertical when the package is in the near-vertical orientation.

8. The package of claim 1, wherein the front wall and the rear wall are substantially parallel to one another.

9. The package of claim 1, wherein the container includes a plurality of recessed lock portions and the lid includes a plurality of locking members so that each recessed lock portion engages a locking member and thereby the lid snap fits to the container.

10. The package of claim 1 further comprising a recessed portion of the rim that is recessed downward from the rest of the rim towards the base, thereby creating a space between the recessed portion of the rim and the lid.

11. A package for containing a foodstuff, comprising:

a container comprising a base having a perimeter and a bottom surface, a front wall, a rear wall, a first side wall and a second side wall, wherein the side walls extend substantially vertically from the perimeter at opposite sides of the base, further wherein the front wall and the rear wall extend from the perimeter at opposite sides of the base, further wherein the front wall extends at a negative angle relative to the bottom surface of the base towards a center of the container;

the container further comprising a substantially horizontal rim disposed along a portion of the front wall, the rear wall, the first side wall, and the second side wall opposite to the base;

a lip formed in the base proximate the front wall;

a front edge formed in the base adjacent the lip and the bottom surface of the base, wherein the front edge is lower than the lip relative to the bottom surface when the package is in a horizontal orientation;

wherein the front portion of the horizontal rim and the lip are adapted to rest on a horizontal surface when said package is in a near-vertical position, further wherein a center of mass of the package to be located above the front wall when the package is in the near-vertical position; and a lid, wherein the lid fits into the rim to contain the foodstuff placed in the container.

12. The package of claim 11, wherein the lip extends substantially along the entire length of the front wall.

13. The package of claim 12, wherein the front edge extends generally perpendicular to the bottom surface substantially along the entire length of the front wall.

14. The package of claim 11, wherein the bottom surface of the base and the front edge of the base fit stably in a lid of a second identical package to allow stable vertical stacking of a plurality of the packages.

15. The package of claim 11, wherein the lid includes a recessed portion that is parallel to the rim towards a center of the lid.

16. The package of claim 11, wherein the negative angle relative to the bottom surface of the base is between about 10 degrees and about 25 degrees relative to a vertical axis.

17. The package of claim 11, wherein the negative angle relative to the bottom surface of the base is approximately 14 degrees relative to a vertical axis.

18. The package of claim 11 further comprising a recessed portion of the rim that is recessed downward from the rest of the rim towards the base, thereby creating a space between the recessed portion of the rim and the lid.

19. A package for containing a foodstuff, comprising:

a container comprising a base having a perimeter, a bottom surface, and a lip and an outward facing front edge formed in the base, a front wall, a rear wall, a first side wall and a second side wall, wherein the side walls extend substantially vertically from the perimeter at opposite sides of the base, further wherein the front wall and the rear wall extend from the perimeter at opposite sides of the base, further wherein the front wall extends at a negative angle relative to the bottom surface of the base towards a center of the container;

the container further comprising a substantially horizontal rim disposed along a portion of the front wall, the rear wall, the first side wall, and the second side wall opposite to the base;

wherein the front portion of the horizontal rim and the lip are adapted to rest on a horizontal surface when said package is in a near-vertical position, further wherein a center of mass of the package to be located above the front wall when the package is in the near-vertical position; and a lid having a first portion non-removably connected to the rim of the container, a second portion removably connected to the rim of the container, wherein the lid fits into the rim to contain the foodstuff placed in the container.

20. The package of claim 19, wherein the lid includes a recessed portion that is parallel to the rim towards a center of the lid.

21. The package of claim 19 wherein the lip is proximate the front wall of the container and wherein the front edge is lower than the lip relative to the bottom surface when the package is in a horizontal orientation.

22. A package for containing a foodstuff, comprising:

a container comprising a base having a perimeter and a bottom surface, a front wall, a rear wall, a first side wall and a second side wall, wherein the side walls extend substantially vertically from the perimeter at opposite sides of the base, further wherein the front wall and the rear wall extend from the perimeter at opposite sides of the base, further wherein the front wall extends at a negative angle relative to the bottom surface of the base towards a center of the container;

the container further comprising a substantially horizontal rim disposed along a portion of the front wall, the rear wall, the first side wall, and the second side wall opposite to the base;

a lip formed in the base proximate the front wall;

a front edge formed in the base adjacent the lip and the bottom surface of the base;

wherein the front portion of the horizontal rim and the lip are adapted to rest on a horizontal surface when said package is in a near-vertical position, further wherein a center of mass of the package to be located above the front wall when the package is in the near-vertical position; and a lid, wherein the lid fits into the rim to contain the foodstuff placed in the container and wherein the lip rests on the horizontal rim of a second identical package when said package is vertically stacked on a second identical package.

* * * * *